US010099474B2

(12) United States Patent
Stoeckle et al.

(10) Patent No.: US 10,099,474 B2
(45) Date of Patent: Oct. 16, 2018

(54) METHOD TO CHECK A PRINT HEAD FOR APPLICATION OF A FIXATIVE IN AN INK PRINTING APPARATUS

(71) Applicant: Océ Holding B.V., Venlo (NL)

(72) Inventors: Ulrich Stoeckle, Munich (DE); Philippe Koerner, Forstinning (DE)

(73) Assignee: Océ Holding B.V., Venlo (NL)

( * ) Notice: Subject to any disclaimer, the term of this patent is extended or adjusted under 35 U.S.C. 154(b) by 55 days.

(21) Appl. No.: 15/441,667

(22) Filed: Feb. 24, 2017

(65) Prior Publication Data

US 2017/0246856 A1 Aug. 31, 2017

(30) Foreign Application Priority Data

Feb. 25, 2016 (DE) ..... 10 2016 103 318

(51) Int. Cl.

| | |
|---|---|
| ***B41J 2/205*** | (2006.01) |
| ***B41J 29/393*** | (2006.01) |
| ***B41J 2/045*** | (2006.01) |
| ***B41J 2/21*** | (2006.01) |

(52) U.S. Cl.

CPC ..... *B41J 2/0451* (2013.01); *B41J 2/04586* (2013.01); *B41J 2/2114* (2013.01); *B41J 2/2142* (2013.01); *B41J 2/2146* (2013.01)

(58) Field of Classification Search

CPC . B41J 2/12; B41J 2/2146; B41J 2/2142; B41J 2/2135; B41J 2/2114

USPC ..... 347/9, 14, 15, 19

See application file for complete search history.

(56) References Cited

U.S. PATENT DOCUMENTS

| | | | | |
|---|---|---|---|---|
| 6,598,965 | B1 | 7/2003 | Lund et al. | |
| 7,281,778 | B2 | 10/2007 | Hasenbein et al. | |
| 7,530,684 | B2 | 5/2009 | Yamanobe | |
| 7,621,614 | B2 | 11/2009 | Endo | |
| 7,645,019 | B2 | 1/2010 | Hirakawa | |
| 8,506,038 | B2 * | 8/2013 | Mizes | B41J 2/2135 347/15 |
| 8,733,877 | B2 * | 5/2014 | Inoue | B41J 2/12 347/14 |
| 2005/0093904 | A1 | 5/2005 | Ishimoto et al. | |
| 2005/0116978 | A1 | 6/2005 | Kubota | |

FOREIGN PATENT DOCUMENTS

| | | | |
|---|---|---|---|
| DE | 10059573 | A1 | 5/2001 |
| EP | 0788882 | B1 | 7/2002 |
| EP | 2418087 | A1 | 2/2012 |

* cited by examiner

*Primary Examiner* — An Do

(74) *Attorney, Agent, or Firm* — Schiff Hardin LLP

(57) ABSTRACT

In a method to check a fixative print head for nozzle failures, a reference mark is printed by the nozzles of a colored ink print head and a test mark is printed via overprinting of the colored ink by the nozzles of the colored ink print head and of a fixative by the nozzles of the fixative print head onto a printing substrate web. The test mark and the reference mark are compared with one another. If the reference mark and the test mark correspond to one another (e.g., at least in part), this indicates that nozzles of the fixative print head are operating incorrectly. If operating incorrectly, the nozzles have, for example, failed entirely or eject the fixative at too great an angular deviation.

17 Claims, 6 Drawing Sheets

METHOD TO CHECK A PRINT HEAD FOR APPLICATION OF A FIXATIVE IN AN INK PRINTING APPARATUS

CROSS REFERENCE TO RELATED APPLICATIONS

This patent application claims priority to German Patent Application No. 102016103318.9, filed Feb. 25, 2016, which is incorporated herein by reference in its entirety.

BACKGROUND

Ink printing apparatuses may be used for single-color or multicolor printing to a printing substrate, including single sheet or belt-shaped printing substrate that can be made from various materials such as, for example, paper or a paper web. An example design of such ink printing apparatuses is illustrated in, for example, EP 0 788 882 B1. Ink printing apparatuses that, for example, operate according to the Drop-on-Demand (DoD) principle have, as a printing unit, a print head or multiple print heads with nozzle units comprising ink channels and activators. The activators—controlled by a printer controller—may excite ink drops in the direction of a printing substrate web. The ink drops are directed onto the printing substrate web in order to apply print dots there for a print image. The activators may generate ink drops thermally (bubble jet) or piezoelectrically.

The design of a print head that has (for example) a nozzle unit with piezoelectric activators is illustrated in U.S. Pat. No. 7,281,778 B2. The nozzle unit can include ink channels that end in nozzles arranged in a nozzle plate, and provides activators that are respectively arranged at an ink channel. The printing substrate web is directed past the nozzle plate. If printing should occur, the activators provided for the printing are activated by a printer controller, which activators thereupon subject the ink in the ink channels to pressure waves via which the ejection of ink drops from the nozzles in the direction of the printing substrate web is induced.

Given low print utilizations of the ink printing apparatus, not all nozzles of the ink print heads are activated in the printing process and many nozzles have downtimes (printing pauses) that can result in the ink in the ink channel of these nozzles not being moved. Due to the effect of evaporation from the nozzle opening, the danger exists from this that the viscosity of the ink then changes. This has the result that the ink in the ink channel can no longer move optimally and, for example, can no longer exit from the nozzle. In extreme cases, the ink in the ink channel dries completely and clogs the ink channel, such that a printing with this nozzle is no longer possible.

The drying of the ink in the nozzles may be prevented in that printing occurs from all nozzles within a predetermined cycle. This cycle may be set corresponding to the print utilization. Individual points may thereby be applied in unprinted regions of the printing substrate web, or print dot lines may be printed between print pages. These methods may lead to disruptions in the print image, in addition to unnecessary ink consumption and additional wear of the print heads.

A drying of the ink in the nozzles of a print head in its printing pauses represents a problem that may also be prevented in that a purge medium (e.g., ink or cleaning fluid) is flushed through all nozzles in a flushing process (also called purging) within a predetermined cycle. This purge cycle may be set corresponding to the print utilization as illustrated in, for example, EP 2 418 087 A1.

In order to improve the fixing of colored ink on the printing substrate web, a fixative can be applied to the regions of the printing substrate web that should be printed to with colored ink. The print regions on the printing substrate web may be determined using the print data. Before the printing, the coating of the printing substrate web may be implemented with a coating unit that may be designed corresponding to an ink print head. For example, if the coating unit has a nozzle plate with nozzles, only the respective print region may be specifically coated with fixative, wherein the coating quantity is also adjustable. Ink printing apparatuses that have such coating units are illustrated in U.S. Pat. No. 7,645,019 B2, U.S. Pat. No. 7,530,684 B2 or DE 100 59 573 A1, for example.

In inkjet printing, special transparent inks may be applied onto the printing substrate web (e.g., by a print head or a print bar made up of print heads) as fixative for the use cases indicated above. The basic function of this operation is to increase the surface tension of the printing substrate web so that the colored ink spreads better and the surfaces that are printed to are closed and produce a homogeneous effect. This is achieved by transferring salts, for example, onto the surface of the printing substrate web. The effect of this surface treatment of the printing substrate web is additionally that a larger quantity of color pigments from the colored ink remain on the surface and modify the color impression relative to an untreated surface.

However, the fixative alone cannot be detected on the surface of the printing substrate web because the fixative penetrates into the surface of the printing substrate web or on its own does not sufficiently modify the appearance of the printing substrate web in order to make it possible to differentiate printed locations from unprinted locations with certainty. This leads to the situation that—during the printing, for example—a check may not be made as to whether all nozzles of the print heads for the fixative are functioning. That is, due to optical properties of the fixative, nozzle errors of these print heads may not be directly detected. Nozzle errors (failures of nozzles or angular deviations in the flight of the fixative towards the printing substrate web) therefore may not be directly evaluated in the printing operation, for example, to introduce countermeasures such as purging.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
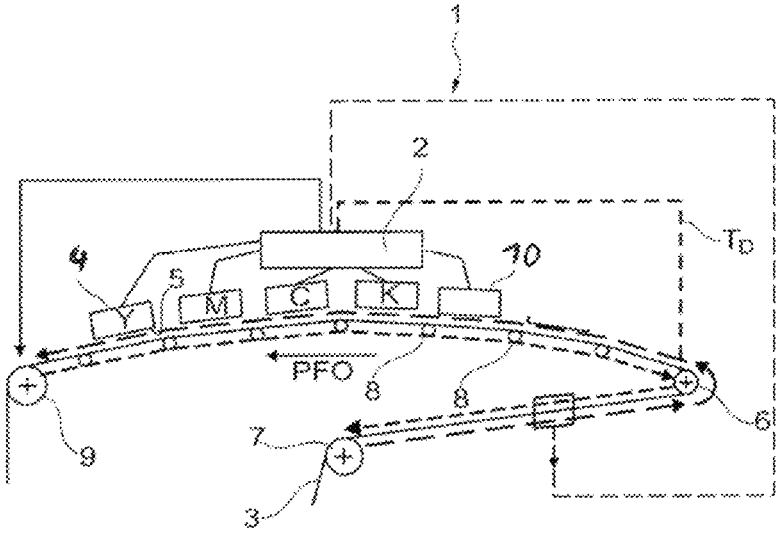
FIG. 1 illustrates a printing unit of an ink printing apparatus with a print bar unit according to an exemplary embodiment of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

Embodiments of the present disclosure solve the problems arising in the related art, and can include a method in an ink printing apparatus, in which a printing substrate web may be coated with a fixative and defects at the nozzles of a print head for the fixative may be detected during the printing operation.

In one or more exemplary embodiments, an ink printing apparatus may provide a print bar unit having at least one print bar arranged over the width of a printing substrate web. The print bar can have at least one print head for a colored ink to be printed (referred to a colored ink print head). In one or more exemplary embodiments, for simplification, it may be assumed that a print bar with only one colored ink print head is used, but embodiments are not limited to the number of print heads. In an exemplary embodiment, to apply a fixative, the print bar may additionally have a print head designed corresponding to the colored ink print head (referred to as a fixative print head).

In one or more exemplary embodiments, a method for pretreating a printing substrate web before printing with print images may be used in the print bar unit. In this example, the printing substrate web is printed with the fixative by the fixative print head. To check whether the fixative print head is functioning with all nozzles, a check can be made as to whether there is a color variation (e.g., chroma shift/tonal value variation) in the print image (e.g., per pixel of the print image) given an overprinting of colored ink and fixative. In an exemplary embodiment, a camera system or other optical sensor can be configured to check the print image, but is not limited thereto.

In an exemplary embodiment, a reference mark may be printed by the colored ink print head onto the printing substrate web over a print row (e.g., at the beginning of the print operation). The reference mark may, for example, consist of a line that has at least one row of print dots or pixels across the print head width of the colored ink print head, where the line has been printed by all nozzles of the colored ink print head. In this example, the line is referred to as a reference line. To obtain a reference value for the check, the level of the mean tonal value/chroma of the colored ink per pixel at the reference mark may be established (e.g., via per-pixel scanning of the reference mark). In an exemplary embodiment, this reference value is used for a comparison and for the later checking of the nozzles of the fixative print head. For this, an additional mark (i.e., a test mark) may be printed across a print row onto the printing substrate web, where the additional mark has been generated via overprinting of the colored ink from the colored ink print head and the fixative from the fixative print head. In an exemplary embodiment, the test mark may in turn consist of a line of at least one row of print dots or pixels that has been printed by all nozzles of the colored ink print head and of the fixative print head; this line is referred to as a test line in the following. In an exemplary embodiment, the test mark may likewise be scanned per pixel, wherein a real value per pixel is obtained that can be compared per pixel with the reference value. In an exemplary embodiment, if a reference value and a real value correspond to one another per pixel, this indicates that the associated nozzle of the fixative print head is operating incorrectly, thus has failed entirely or ejects the fixative with too large an angular deviation.

Advantages of the present disclosure include, for example:

- Failures of nozzles in a fixative print head may be determined, such that countermeasures (for example purges) may be initiated.
- The adjustment of the print heads for the fixative in the printing apparatus may be implemented exactly, with reduced expenditure.
- The nozzle error detection may be implemented with, for example, the aid of a line (reference line) in the print image region on the printing substrate.
- A targeted, digital monitoring of the print quality is possible in continuous printing.

FIG. 1 illustrates a printing apparatus according to an exemplary embodiment of the present disclosure. The printing apparatus can include a printing unit 1 for printing to a printing substrate web 3; a transport unit 8 for the printing substrate web 3, having a roll saddle and drive rollers 7, 9; and a printer controller 2. Arranged along the printing substrate web 3 is a print bar unit DE which has print bars 4 with print heads 5 in series, as viewed in the transport direction PF of the printing substrate web 3. Given color printing, a respective print bar 4 may be provided per color to be printed, for example. The printing substrate web 3 is moved past the print bars 4 with the aid of drive rollers 7, 9; it thereby rests on the roll saddle. Arranged at the intake of the print bar unit DE is a sensor 6 that is configured to generate print clock pulses $T_D$ based on the feed movement of the printing substrate web 3. The print clock pulses $T_D$ can be supplied to the printer controller 2. The printer controller 2 can be configured to establish the point in time of the ejection of ink droplets at the nozzles of the individual print heads 5 if print data ready for printing are present in the printer controller 2 (e.g., based on the print clock pulses $T_D$). The sensor 6 may be a rotary encoder or encoder roller 6 that is driven by the printing substrate web 3, but is not limited thereto.

Figure 2:
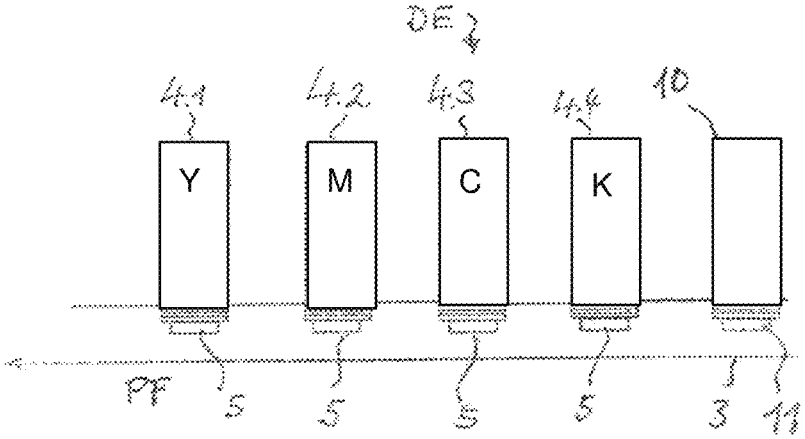
FIG. 2 illustrates a print bar unit with multiple print bars according to an exemplary embodiment of the present disclosure.

FIG. 2 illustrates a print bar unit DE according to an exemplary embodiment of the present disclosure. Print bar unit DE can include a print bar 4.1 for the color Y (yellow), a print bar 4.2 for the color M (magenta), a print bar 4.3 for the color C (cyan), a print bar 4.4 for the color K (black), respectively. The print bar DE can have one or more other print bars 4 for one or more other respective colors, or few print bars 4 in other embodiments. In an exemplary embodiment, the print bar unit DE can include a print bar 10 as a coating unit (or coating bar) 10 that is configured to coat the printing substrate web 3 with a fixative. In an exemplary embodiment, the coating unit print bar 10 is arranged before the print bars 4.1 through 4.4, as viewed in the transport direction PF of the printing substrate web 3. In an exemplary embodiment, the print bars 4.1 through 4.4 have print heads 5. In an exemplary embodiment, the coating unit 10 is configured correspondingly to the print bars 4.1 through 4.4, and can include one or more fixative print heads 11. The fixative print head(s) can correspond to the print heads 5 in one or more embodiments.

In the following discussion, exemplary embodiments are described that include a print bar 4 having only one color ink print head 5 and a coating unit 10 including a fixative print head 11. However, exemplary embodiments are not limited thereto and can include other quantities of print bars 4 (and corresponding print heads 5) and/or coating units 10 (and corresponding fixative print heads 11) as would be understood by one of ordinary skill in the relevant arts. For example, exemplary embodiments can include a print bar unit DE having multiple print bars 4 with multiple respective print heads 5 and/or having the coating unit 10 including a number of fixative print heads 11 corresponding to the number of color ink print heads 5. The fixative can also be referred to as a primer.

Figure 8:
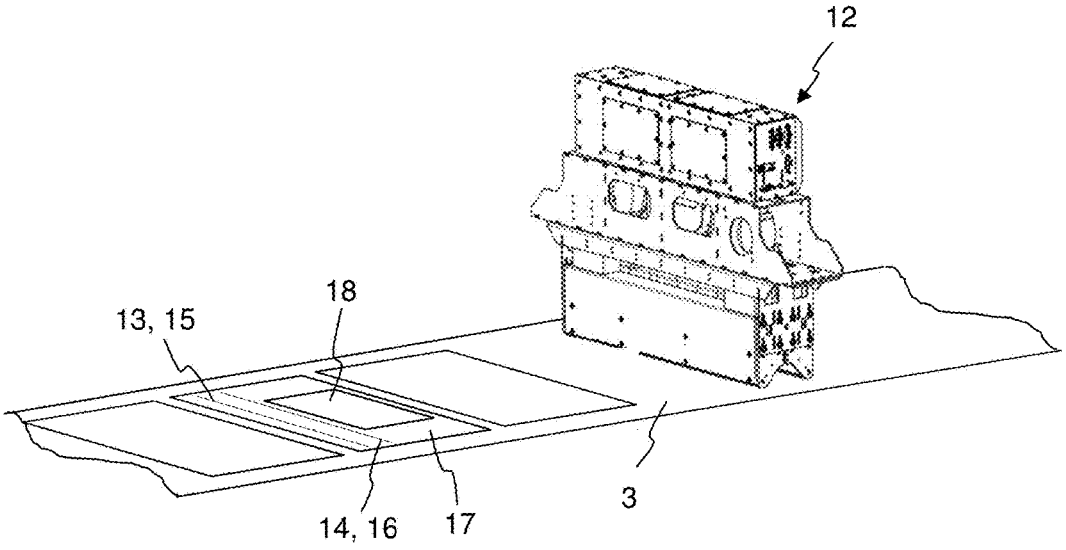
FIG. 8 illustrates a camera system for scanning the marks according to exemplary embodiments of the present disclosure.

In an exemplary embodiment, the ink printing apparatus 1 includes one or more print bar units DE having one or more print bars 4 arranged across the printing width of a printing substrate web 3. The print bar(s) 4 can include one or more print heads 5. In an exemplary embodiment, the coating unit (coating head) 10 having a fixative print head 11 is configured to pre-treat the printing substrate web 3 with a fixative before print images are printed to the substrate web 3 (i.e., by the print bar(s) 4). Methods according to exemplary embodiments are described below that are configured to check whether the print head 11 that prints the fixative onto the printing substrate web 3 is correctly functioning (e.g., without problems) with all nozzles. In an exemplary embodiment, one or more of the methods can include, a mark being respectively applied onto the printing substrate web 3 with a colored ink alone (i.e., reference mark 13) and with a mark via overprinting of a fixative and the colored ink (i.e., test mark 14). The marks (e.g., marks 13 and 14) can then be subsequently measured. In an exemplary embodiment, it may be determined whether all nozzles of the fixative print head 11 have functioned without problems (i.e., are functioning correctly) based on a comparison of the marks (e.g., comparison of the reference mark 13 and the test mark 14) per pixel of the marks (e.g., marks 13 and 14). In an exemplary embodiment, the comparison of the reference mark 13 and the test mark 14 can be used to determine if one or more of the nozzles of the fixative print head 11 is functioning correctly. Examples of the reference mark 13 and the test mark 14 according to exemplary embodiments of the present disclosure are shown in FIG. 8.

First Exemplary Checking Method

Figure 5:
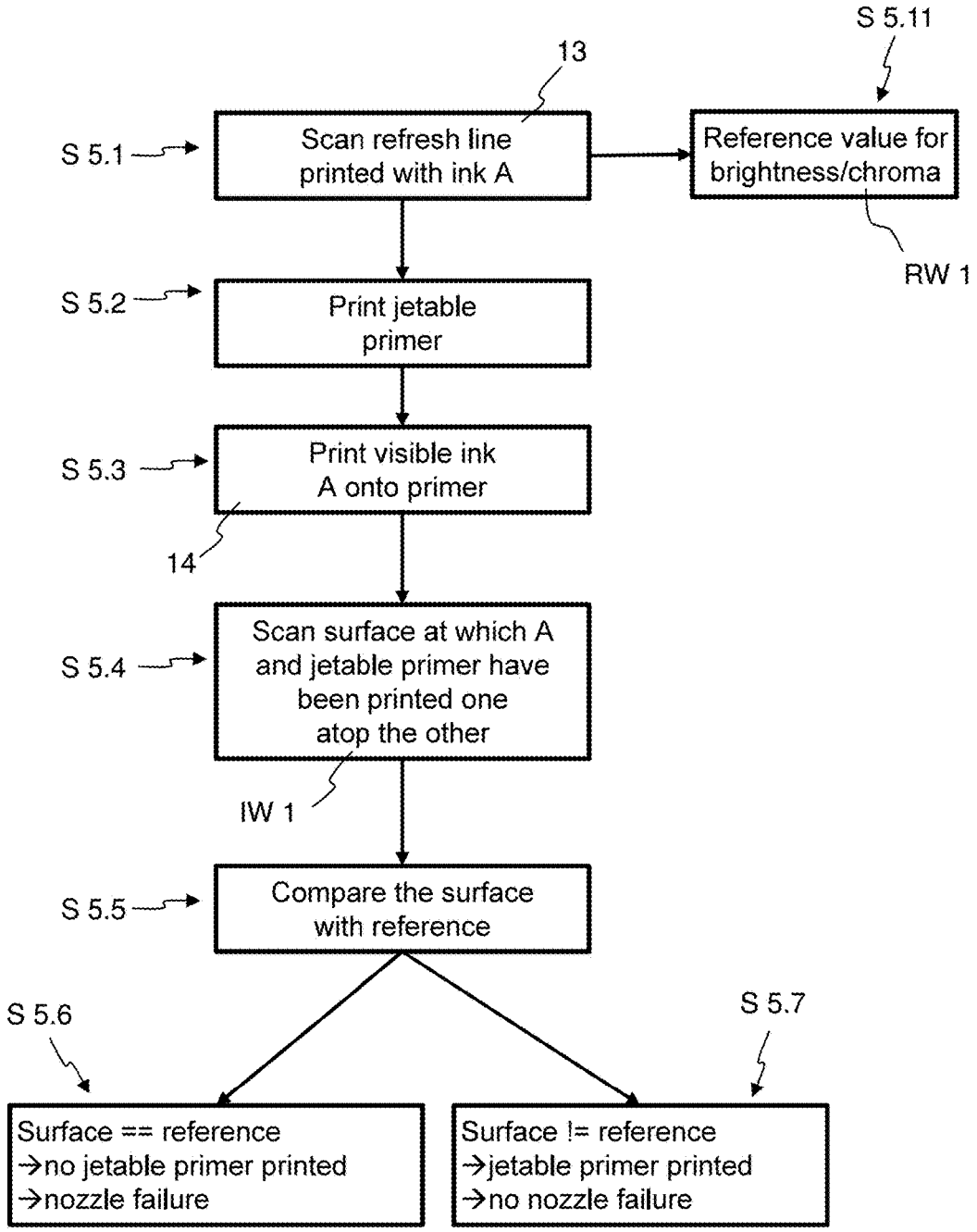
FIG. 5 illustrates a workflow diagram of a method to check the nozzles of the fixative print head using tonal value of a reference mark and of a test mark according to an exemplary embodiment of the present disclosure.

In an exemplary embodiment, with reference to FIG. 5, a check is made as to whether there is a color variation (e.g., chroma shift/tonal value variation) in the print image of the test mark 14, per pixel of the print image, given the printing of a colored ink onto the fixative. In an exemplary embodiment, the test mark 14 is checked using a camera system 12 (FIG. 8). For this, a reference mark 13 may be printed by the colored ink print head 5 onto the printing substrate web 4 (e.g., at the beginning of the printing operation) to establish, by scanning of the reference mark 13, the level of the mean tonal value/chroma of the colored ink on the reference mark 13. This comparison may be used for the later checking of the nozzles of the fixative print head 11. In an exemplary embodiment, the test mark 14 is generated by overprinting the fixative and the colored ink. In an exemplary embodiment, the tonal value of the test mark 14 is also determined with the aid of the camera system 12 (FIG. 8). In an exemplary embodiment, via a comparison of the tonal values of the reference mark 13 and the test mark 14, it may be established whether nozzles of the fixative print head 11 are operating incorrectly.

In an exemplary embodiment, the print images of the marks 13, 14 may be a line generated across the printing width of the print heads 5, 11 by their respective nozzles. The line can be made up of at least one print dot row, where each nozzle of the print heads 5, 11 generates a print dot of the print dot row on the printing substrate web 3. In an exemplary embodiment, with reference to FIG. 6, if only the colored ink print head 5 prints a line on the printing substrate web 3, the reference line 15 is generated as a reference mark 13. If both print heads 5, 11 print a line on the printing substrate web 3 via overprinting, the test line 16 is generated as a test mark 14. An example of the arrangement of the reference line 15 and the test line 16 may be learned from FIG. 6 and analyzed using the system shown in FIG. 8.

In an exemplary embodiment, the marks 13, 14 are realized as respective lines, but are not limited thereto. For example, the reference mark 13 and/or the test mark 14 can have a different form, such as a printed dot, or other form as would be understood as one of ordinary skill in the relevant arts. In an exemplary embodiment, the reference mark 13 and the test mark 14 are constructed so that the tonal value TW may be determined per print dot.

Figure 3:
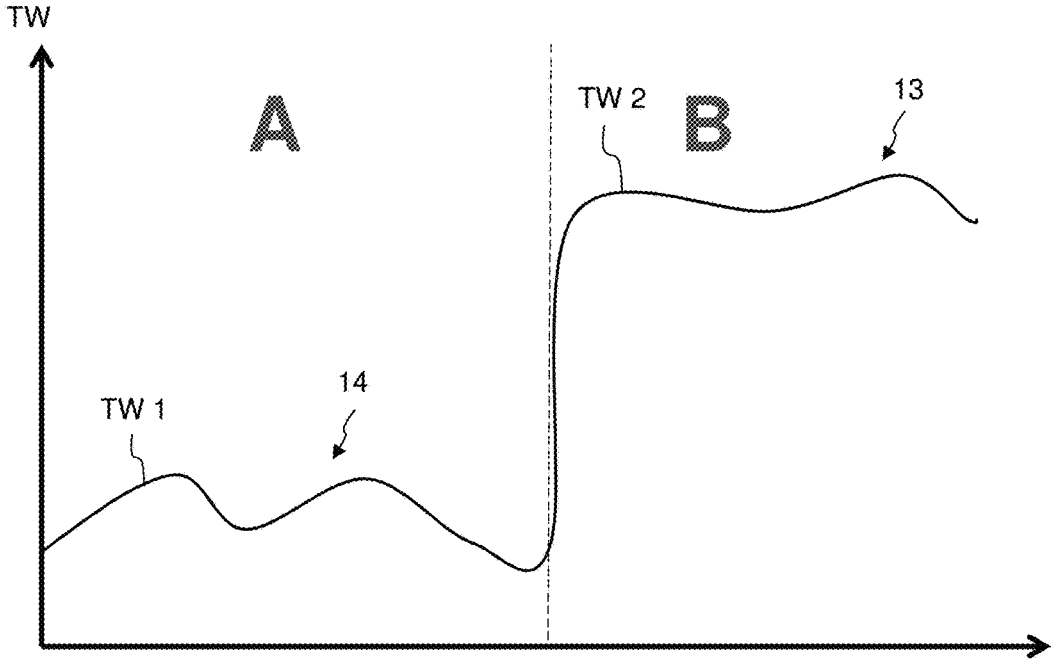
FIG. 3 illustrates tonal values of a color image with and without use of a fixative according to exemplary embodiments of the present disclosure.

FIG. 3 illustrates an example of a result of an evaluation of a reference mark 13 and a test mark 14 according to an exemplary embodiment. The region A of FIG. 3 shows the tonal value TW1 of the test mark 14 given an overprinting of fixative and colored ink. The region B of FIG. 3 shows the tonal value TW2 of the reference mark 13 given printing with only a colored ink. Via the tonal value difference of the two marks 13, 14, it may be established where a colored ink alone has been printed (e.g., region B of FIG. 3) or whether a colored ink has been printed over a fixative (e.g., region A of FIG. 3). From a corresponding checking of all pixels of the marks 13, 14 across the width of the marks 13, 14, it may therewith be established whether nozzles of the fixative print head 11 are functioning incorrectly or not at all.

Figure 4:
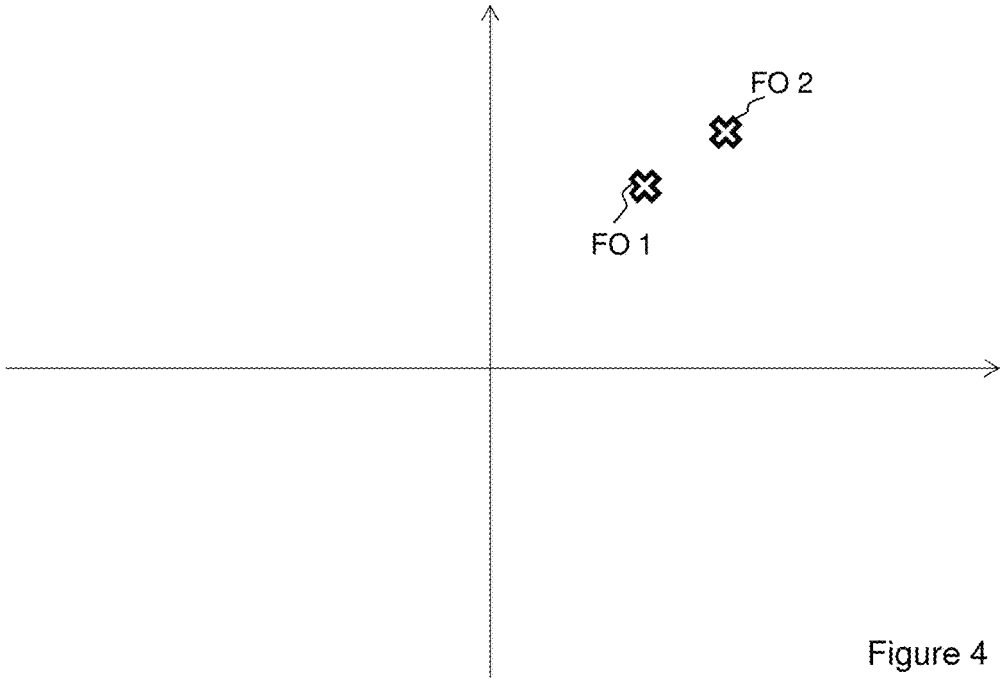
FIG. 4 illustrates color locations of a color image with and without use of a fixative according to exemplary embodiments of the present disclosure.

With reference to FIG. 4, in an exemplary embodiment, it can be established whether the fixative has been printed or not based on a shift of the tonal value of the two marks 13, 14. In an exemplary embodiment, this determination can be based on one or more color locations of the marks 13, 14. For example, the color location FO1 or FO2 of the mark 14 or of the mark 13 may be determined, and it may be established whether the fixative has been printed or not based on the color location of the marks 13, 14 and/or a shift of the tonal value of the two marks 13, 14.

FIG. 5 illustrates a workflow of a checking method according to an exemplary embodiment of the present disclosure. In an exemplary embodiment, the checking thereby takes place per nozzle of the fixative print head 11, and therefore per pixel of the test mark 14.

In step S5.1, the reference mark 13 (reference line 154) printed with the colored ink A is evaluated. The determined value is stored as a reference value RW1 for the tonal value (e.g., brightness, chroma) (S5.11). In step S5.2, a mark with only the fixative (e.g., primer) is printed onto the printing substrate web 3. In the following step S5.3, colored ink A is printed at this mark and the test mark 14 is therefore generated. In step S5.4, the test mark 14 is scanned and its tonal value is determined as a real value IW1. A comparison of the real value IW1 of the test mark 14 with the reference value RW1 subsequently follows in step S5.5. The result of the comparison can be:

The real value IW1 corresponds to the reference value RW1 (step S5.6): no fixative has been printed:

→The nozzle of the fixative print head 11 that is provided for printing has failed; or The real value IW1 does not correspond to the reference value RW1 (step S5.7): the fixative has been printed below the colored ink:

→The nozzle of the fixative print head 11 that is provided for printing has printed the fixative onto the printing substrate web 3.

Second Exemplary Checking Method

In a checking method according to an exemplary embodiment, it is examined whether mark 14 (test mark 14), printed by the individual nozzles of the colored ink print head 5 and the fixative print head 11, differs in terms of its width from the width of the reference mark 13. Lines consisting of print dot rows of the heads 5, 11 (reference line 15, test line 16, FIG. 8) may again be used as marks 13, 14.

Figure 6:
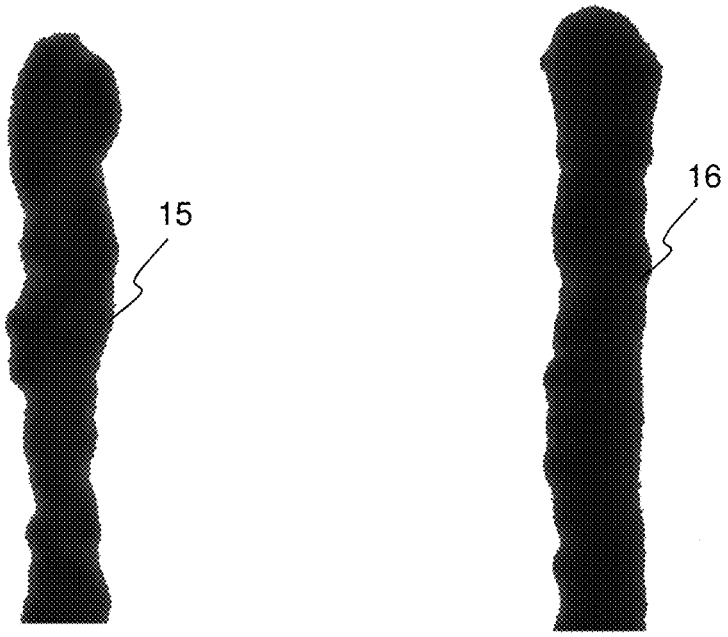
FIG. 6 illustrates line widths of lines generated on a printing substrate web according to exemplary embodiments of the present disclosure.

FIG. 6 shows an example of a reference line 15 and a test line 16. The reference line 15 that has been printed only by the nozzles of the color ink print head 5. Shown next to this is the test line 16 that has been created by overprinting of the fixative and a colored ink. The lines 15, 16 may be detected with the camera system 12 (FIG. 8) to establish the difference in the width of the lines 15, 16.

Figure 7:
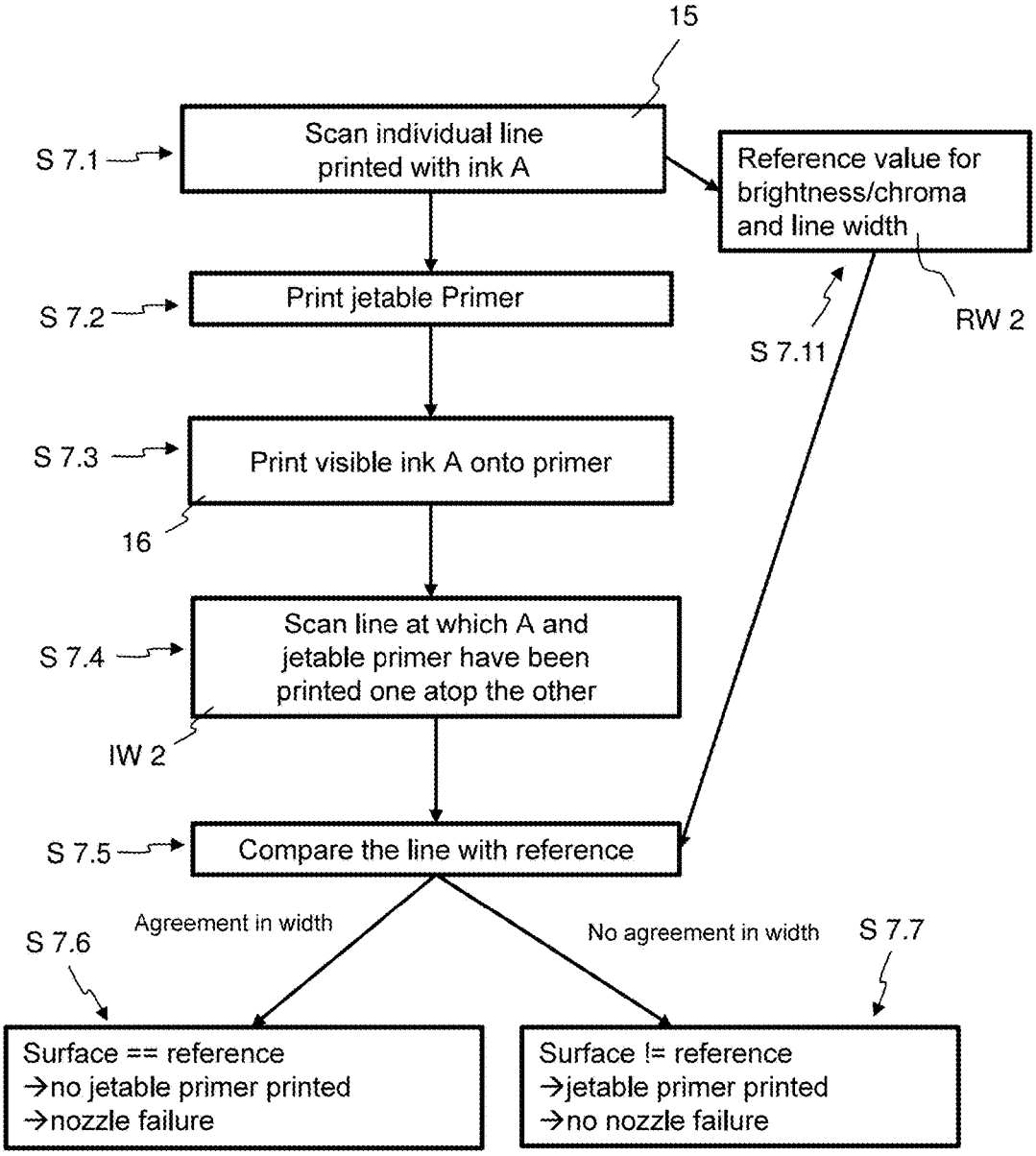
FIG. 7 illustrate a workflow diagram of a method to check the nozzles of the fixative print head using the line width of the reference mark and of the test mark according to an exemplary embodiment of the present disclosure.

A checking method according to an exemplary embodiment is illustrated in FIG. 7. In an exemplary embodiment, in step S7.1, the width of the reference line 15 is measured. In this example, the reference line 15 has been printed by the nozzles of the colored ink print head 5 with the color A. The measurement result is subsequently stored as a reference value RW2 for the brightness/chroma and line width (step S7.11). In step S7.2, a line is printed with the nozzles of the fixative print head 11 that are to be checked. The colored ink A is then printed on this line by the colored ink print head 5 (step S7.3), and the test line 16 is therewith generated. The width of the test line 16 made up of fixative and colored ink A is determined as a real value IW2. The real value IW2 is compared with the reference value RW2 (step S7.5). The result of this comparison may be:

The widths of the test line 16 and the reference line 15 coincide (step S7.6):

→no fixative was printed by the respective nozzle of the fixative print head 11; a nozzle failure is present in the fixative print head 11; or The widths of the test line 16 is not equal to that of the reference line 15 (step S7.7):

→no nozzle error is present the fixative print head 11.

In an exemplary embodiment, this method may be implemented across all nozzles of the fixative print head 11, and therefore all nozzles of the fixative print head 11 may be checked. In another exemplary embodiment, the method is applied to only a subset of the nozzles of the fixative print head 11 so that only some of the nozzles are checked.

In an exemplary embodiment, one or more print dot rows, as marks 13, 14 to be evaluated, may be printed across a print head width on the printing substrate web 3 by the nozzles of the print heads 5, 11, and these print dot rows may subsequently be scanned. This method may be implemented for a portion of the colored inks or for all colored inks, for example in order to determine whether a print head 5 for the colored ink has nozzle failures or is operating incorrectly, and not the fixative print head 11.

In order to respectively examine individual nozzles of the fixative print head 11, it would be possible that only the respective nozzles of the colored ink print head 5 and of the fixative print head 11 print the print dots on the printing substrate web 3, such that the print dots of the print dot row can be uniquely associated with the nozzles. The method may be implemented for different combinations of the nozzles of the print heads 5, 11 so that all nozzles of the fixative print head 11 may be checked.

An example of an evaluation unit for the marks 13, 14 is illustrated in FIG. 8. Here, a printing substrate web 3 is shown on which is arranged a camera system 12 that is configured to scan the marks 13, 14 on the printing substrate web 3. A print image region 17 having a print image 18 on the printing substrate web 3 is schematically depicted; adjacent to the print image 18, in the print image region 17 a reference line 15 (reference mark 13) may be applied by a colored ink print head 5 and a test line 16 (test mark 14) may be applied jointly by the colored ink print head 5 and the fixative print head 11. The camera system 12 can be configured to scan the two lines 15, 16 and deliver the scan signals to a controller (e.g., printer controller 2 according to FIG. 1). In an exemplary embodiment, the camera system 12 can include processor circuitry that is configured to perform one or more operations and/or functions of the camera system 12. The controller (e.g., controller 2) can be configured to implement a checking of the scan signals according to one or more of the checking methods according to exemplary embodiments of the present disclosure.

For example, in the method according to FIG. 7, resolution greyscale images of the marks 13, 14 may be acquired with an in-line camera, and scan signals that are examined per-pixel may be generated depending on the shape of the marks 13, 14. If a pixel exceeds a predetermined threshold, this pixel may be assessed as a print dot.

The control data for the coating unit 10 may be obtained from the print data. For example, the control data may be developed by a controller from the print data and supplied to the printer controller 2. The printer controller 2 can be configured to control the coating unit 10 based on the control data and/or on additional signals required for the printing operation, for example the print clock pulses $T_D$ (FIG. 1). In an exemplary embodiment, the printer controller 2 can include processor circuitry that is configured to perform one or more operations and/or functions of the printer controller 2.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, "processor circuitry" can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

DB print image
DE print bar unit
PF transport direction of the printing substrate web
TD print clock pulse
TW tonal value
RW reference value
IW real value
1 printing unit
2 printer controller
3 printing substrate web
4.1 through 4.4 print bar
5 colored ink print head
6 sensor
7 drive roller
8 roll saddle
9 drive roller
10 coating unit
11 fixative print head
12 camera system
13 reference mark
14 test mark
15 reference line
16 test line
17 print image region
18 print image

What is claimed is:

1. A method for checking for a nozzle failure of a print head adapted to apply a fixative in an ink printing apparatus, the method comprising:

generating, using a print head for a colored ink, a reference mark from the colored ink on a printing substrate web;

printing, using the print head configured to apply the fixative, the fixative on the printing substrate web;

successively printing, using the print head for the colored ink, colored ink over the fixative printed on the printing substrate web to generate a test mark;

measuring the reference mark to generate a reference value and the test mark to generate a real value;

comparing the reference value and the real value; and assessing operation of the fixative print head based on the comparison of the reference value and the real value.

2. The method according to claim 1, wherein:

generating the reference mark comprises: generating, using the colored ink print head, at least one print dot row made up of the colored ink; and generating the test mark comprises: generating, using the colored ink print head together with the fixative print head, at least one print dot row as the test mark via overprinting.

3. The method according to claim 2, wherein the reference mark comprises: print dot rows printed by the colored ink print head that are combined to form a reference line.

4. The method according to claim 3, wherein the test mark comprises print dot rows printed atop one another by the fixative print head and the colored ink print head that are combined to form a test line.

5. The method according to claim 4, wherein the reference line and the test line are evaluated per pixel, and, given identity of pixels in both of the reference line and the test line, nozzles of the fixative print head that are associated with these pixels of the reference line and the test line are assessed as operating incorrectly.

6. The method according to claim 5, wherein:

measuring the reference mark comprises determining a tonal value of the reference mark to generate the reference value; and measuring the test mark comprises determining a tonal value of the test mark to generate the real value.

7. The method according to claim 5, further comprising:

determining a color location of the reference mark to generate the reference value, and determining a color location of the test mark to generate the real value.

8. The method according to claim 5, further comprising:

determining a width of the reference mark to generate the reference value; and determining a width of the test mark to generate the real value.

9. The method according to claim 1, wherein:

measuring the reference mark comprises determining a tonal value of the reference mark to generate the reference value; and measuring the test mark comprises determining a tonal value of the test mark to generate the real value.

10. The method according to claim 1, further comprising:

determining a color location of the reference mark to generate the reference value, and determining a color location of the test mark to generate the real value.

11. The method according to claim 1, further comprising:

determining a width of the reference mark to generate the reference value; and determining a width of the test mark to generate the real value.

12. The method according to claim 1, further comprising:

implementing a cleaning operation at the fixative print head if the assessing the operation of the fixative print head indicates an error associated with the fixative print head.

13. The method according to claim 1, further comprising:

scanning, using a camera of a measurement unit arranged adjacent to the printing substrate web, the printing substrate web with the reference mark and the test mark, wherein the generation of the reference value or the real value is based on a shape of a corresponding one of the reference mark and the test mark, and wherein the reference mark and the test mark are examined per pixel, and, if a pixel exceeds a predetermined threshold, the pixel is associated with the real value or the reference value.

14. A computer program product embodied on a computer-readable medium comprising program instructions, when executed, causes a processor to perform the method of claim 1.

15. An inkjet printing system configured to perform the method of claim 1.

16. An inkjet printing system comprising a printer controller, the printer controller being configured to perform the method of claim 1.

17. A method for checking operation of a print head in an ink printing system, the method comprising:

generating, using a first print head, a reference mark on a printing substrate web;

generating a test mark on the printing substrate web, using the first print head and a second print head configured to apply a primer, the generation of the test mark including:

printing, using the second print head, the primer on the printing substrate web, and printing, using the first print head, ink over top of the primer printed on the printing substrate web;

determining a reference value based on the reference mark and a real value based on the test mark; and determining an operational error of the second print head based on a comparison of the reference value and the real value.

* * * * *